United States Patent [19]

Hoorelbeke

[11] 4,004,744

[45] Jan. 25, 1977

[54] WINDING APPARATUS

[75] Inventor: Luc Hoorelbeke, Kortrijk, Belgium

[73] Assignee: N.V. Bekaert S.A., Zwevegem, Belgium

[22] Filed: Mar. 21, 1975

[21] Appl. No.: 560,619

[30] Foreign Application Priority Data

Apr. 2, 1974 United Kingdom ..... 14582/74

[52] U.S. Cl. ..... 242/25 R; 242/158.2; 242/158.4 R

[51] Int. Cl.[2] ..... B65H 54/28

[58] Field of Search ..... 242/158.2, 158 R, 25 R, 242/158

[56] References Cited

UNITED STATES PATENTS

| | | | |
|---|---|---|---|
| 3,038,674 | 6/1962 | Wahl | 242/25 R |
| 3,677,483 | 7/1972 | Henrich | 242/25 R |
| 3,876,167 | 4/1975 | Nittschalk et al. | 242/158.2 |

*Primary Examiner*—George F. Mautz
*Attorney, Agent, or Firm*—Shlesinger, Arkwright, Garvey & Dinsmore

[57] ABSTRACT

Winding apparatus for winding wire, thread or the like onto a flanged spool including a thread guide for traversing the wire or thread back and forth lengthwise of the spool during winding and means for detecting surface irregularities of the wound wire or thread in two zones each adjacent to a respective one of the spool flanges. The means for detecting surface irregularities comprises a buffer-accumulator located upstream of the spool, a linear speed sensor located between the spool and the buffer accumulator, and gating means for inhibiting the output from the sensor except when the thread guide is in a position to guide the thread or wire into one of said zones.

15 Claims, 6 Drawing Figures

WINDING APPARATUS

This invention relates to winding apparatus for winding a thread onto a flanged spool and comprising a thread guide arranged to traverse the thread back and forth lengthwise of the spool during winding. In such a way it is intended that the thread be equally distributed over the spool between the spool flanges. It will be understood that the term "thread" embraces any filament, regardless of cross-section, of any substance. The invention is more particularly, but not exclusively, concerned with winding apparatus for winding wire.

In known types of such winding apparatus for winding wire, the turning-points of the back-and-forth movement of the wire guide in general do not precisely correspond to the positions of the flanges. In the case when the wire guide passes slightly beyond the flange position before arriving at its turning-point, the wire is wound over the zone adjacent to the flange for a comparatively longer time than over the other parts of the spool, and a small accumulation is formed in that zone. Conversely, when the wire guide cannot react the flange position because it reaches its turning-point before, a small deficiency in the wound wire surface is formed in the zone adjacent to the flange. Both types of surface irregularities are undersirable, and for this reason it is desired that the turning-points of the back-and-forth movement coincide as accurately as possible with the flange positions.

The flange positions are however different from spool to spool, not only because the distance between the flanges differs, but also because different spools will not be mounted in the apparatus in exactly the same position. The flanges also can have a slightly conical form instead of being completely flat, so that the flange-to-flange distance of the successive layers of wound wire slowly varies during the winding-up operation of a single spool. As a consequence, the turning-points of the back-and-forth movement must continuously be adapted to the positions of the flanges. The indication that the turning-point is located too much outwardly is given by the appearance of an accumulation in the wire surface on the spool near the flange, and conversely a deficiency adjacent to a flange is a sign that the turning-point at that flange is located too much inwardly. A control system, either automatic or visual, can thus be based on the detection of surface irregularity in the zones adjacent to the flanges, for controlling and correcting the positions of the turning-points.

This invention relates more particularly to the method of detecting irregularities of the surface of the wound wire in the zones adjacent to the flanges of a spool during winding by the winding apparatus, and to the type of detector comprised in such apparatus.

One known type of detector detects, at the moment when the wire guide leads the wire over the zone adjacent to the flange, the surface irregularity by sensing the change in tension in the wire on its way to the spool. When indeed the wire is spooled over an accumulation, the apparatus tends to draw more wire from the delivering device upstream, and the resulting sudden increase of tension is registered as an indication of an accumulation. Conversely, a sudden fall in tension is registered as an indication of a deficiency. Such a detector includes a dancer-pulley, over which the wire is led on its way to the spool, which dancer-pulley is movable but is biased by a spring so as to take up the slack in the wire in a position which is representative of the tension in the wire. Tension shocks are then detected by the sudden movements of the dancer-pulley. A tension shock is however not only provoked by surface irregularities of the wire surface on the spool, but can also occur as a result of any variation of delivering speed or counter-resistance of the delivering device upstream of the dancer-pulley, and such tension-shock has no relation with any surface irregularity on the spool. As a consequence, this type of detector proves to be inadequate for spoolers where the wire is delivered from an apparatus with frequently changing delivering conditions, such as wire-drawing machines.

Another known type of detector detects, at the moment when the wire guide leads the wire over the zone adjacent to the flange, the surface irregularity by sensing the change in rotational speed of the spool. When the wire is spooled over an accumulation, the apparatus tends to draw more wire from the delivering device upstream, and the resulting increase of tension provokes a sudden fall of rotational speed of the spooler, which is measured and registered as an indication of an accumulation. Conversely, a sudden rise of rotational speed of the spooler is registered as an indication of a deficiency. However, again the changing delivering conditions of the upstream delivering device can provoke such speed changes which are not desired. But, much worse, the spool has in most cases a great inertia, much greater than the delivering device, so that the rotational speed does not change remarkably and is less usuable as a detector signal. Especially when a dancer-pulley is used for smoothing out the tension shocks, practically no change of rotational speed can be registered.

According to this invention there is provided winding apparatus for winding a thread onto a flanged spool and comprising a thread guide arranged to traverse the thread back and forth lengthwise of the spool during winding, the apparatus further comprising means for detecting surface irregularities of the wound thread in two zones each adjacent to a respective one of the spool flanges, said detecting means comprising a buffer-accumulator located upstream of the spool, and means for sensing changes of the linear speed of the thread upstream of the spool, which sensing means is located between the spool and the buffer-accumulator, and gating means for inhibiting the output from the sensing means except when the thread guide is in a position to guide the thread into one of said zones.

This invention also extends to a method of detecting, during the winding of a thread onto a flanged spool by a winding apparatus having a thread guide which traverses back and forth lengthwise of the spool, irregularities of the surface of the wound thread in two zones each adjacent to a respective one of the flanges of the spool, the method comprising sensing changes of the linear speed of the thread being supplied to the spool when the thread guide guides the thread into one of said zones, said changes being sensed between the spool and an upstream located buffer-accumulator.

A simple buffer-accumulator can be realized by a dancer-pulley as referred to above. At the moment when the surface irregularity occurs, the wire delivering device continues to deliver at the same wire speed, whilst the linear speed of the wire on the side of the spool can freely vary because the dancer-pulley compensates for the difference of speed between the delivering side and the spooling side. Any other device, capable of compensating for such speed difference, can do this work and is called here in general, a buffer-accumulator.

The change of linear speed of the wire between the spool and an upstream accumulator is a variable which is representative of the surface irregularity which is not disturbed by wire tension variations or variations of speed of the wire delivering device.

When the thread, e.g. a wire, is wound on an accumulation, assuming that the wire-spool keeps its rotational speed, the wire being supplied to the spool undergoes an increase in linear speed; the converse also holds. This change of linear speed is registered by the sensing means, which may be a device capable of giving an ouput signal, electrical or of any other nature whatsoever, representative of the change of speed of the wire.

When a wire tension variation occurs, due to the variation of the speed of the wire delivering device, this variation is taken up by the buffer-accumulator which keeps an approximately constant value for the tension of the wire going from the accumulator to the spool. This allows the spool, whatever its inertia may be with respect to the inertia of the wire delivering device, to keep its rotational speed. And the linear speed then remains representative of the radius on which the wire is wound.

When the delivering device is of a nature which frequently provokes tension and speed shocks, the use of such a buffer-accumulator upstream of the sensing means smooths out such shocks, and prevents consequent false signals from being produced by the detector. Such a simple possibility for preventing when necessary the perturbing shocks at the delivering device cannot be realized where the above-mentioned known methods of measuring surface irregularity are used.

In a preferred embodiment of this invention in which the thread guide is arranged to traverse the thread back and forth between two adjustably positionable turning-points, the winding apparatus includes two control systems each of which is arranged to adjust the position of a respective one of the turning-points, with respect to the position of the corresponding spool flange, in response to a respective output signal from the detecting means in such a direction as to compensate for the detected surface irregularity of the wound thread in the respective one of said two zones.

The sensing means senses a change of linear speed of the thread, e.g. wire, occuring at any moment; that is to say, also the speed changes occurring at moments when the wire guide is not in a position to guide the wire into one of the zones adjacent to the spool flanges. Such latter speed changes must not be sensed and interpreted as surface irregularities giving rise to a change of position of the turning-points, or at least the output signal resulting from such sensed speed changes must be made inoperative. This is the function of the gating means, which cooperates with two wire-guide-to-flange proximity sensors. Each of these sensors may be constituted by any suitably mounted device which is capable of switching from one condition (a rest-condition) to another (actuated) condition when the wire guide reaches a position where the wire begins to be wound up in a small zone adjacent to the flange (that is to say a zone corresponding to the breadth of possible accumulations or deficiencies near the flange) and capable of turning back to the rest-condition when the wire guide again leaves that position. Micro-switches or other known magnetic, ultrasonic or photo-electric devices can be used as proximity sensors which move, for instance, together with the wire guide and directly detect the proximity of the flange, but it is clear that many other devices and principles can be used to detect said position of the wire guide. The gating means can be constituted by any suitable switching device, e.g. by simple electrical contact relays for interrupting the output signal of the sensing means, or by other electronic methods, or alternatively by interrupting the input to the sensing means or by interrupting its operation. Those skilled in the art can easily design different systems of operation without departing from the scope of this invention.

The linear speed of the wire can be measured by a freely rotatable guiding-pulley over which the wire is passed in non-sliding contact, so that the pulley turns at a rotational speed which is proportional to the linear speed of the wire. The sensing means then preferably comprises, in addition to said guiding means pulley, means for sensing changes of the rotational speed of said guiding pulley. This rotational speed is more easy to monitor, e.g. by electromagnetic or photo-electric means, than is the linear speed of the wire, although the sensing means can alternatively be based on direct magnetic or photo-electric observation of the linear speed of the wire. In general, the sensing means, for sensing changes of either linear or rotational speed, comprises for instance a speed-meter, which need not necessarily have a linear response, followed by a differentiator.

The turning-points of the back-and-forth movement of the wire guide must be adjustably positionable. In most cases the turning-points are determined by adjustably positionable end-sensors, such as micro-switches, operatiove automatically to reverse the direction of operation of the wire-guide at the end of each traverse. The correction of the position of the turning points or end-sensors in dependence on the detected surface irregularities may be done by hand, but is preferably done automatically by the two control systems, or servomechanisms, referred to above, one for each turning point. The output of the detecting means is then constituted by the output of the sensing means which output is blocked by the gating means when the wire-guide-to-flange proximity sensors are in the rest condition. In such a way, the detector can only be active when the wire-guide is near one of the flanges. For serving as an input signal generator for the two control systems, one for the left and one for the right hand turning-point, the detector must also only be operative on a control system corresponding to one side, with respect to surface irregularity signals on that side only. For that reason, where the correction of the position is done automatically with two control-systems, one for each side, the gating means cooperates with the two wire-guide-to-flange proximity sensors to allow the transmission of the output of the sensing means to the corresponding control system only when the corresponding proximity sensor is in an actuated condition.

It must be noted that the two control systems need not necessarily be two physically separate circuits but may be constituted by a single circuit, working in time-sharing, first for the left hand system and then for the right hand one, and so on. In the same way the detecting means can have two outputs, one for each side, but it can alternatively have only one output which delivers signals alternately for the two sides, where the control systems alternately accept those signals. Many other ways of realizing the control systems can be designed by those skilled in the art without departing from the scope of this invention.

By way of example, one embodiment of winding apparatus in accordance with the invention is described below with reference to the accompanying drawings, in which.

Figure 3A:
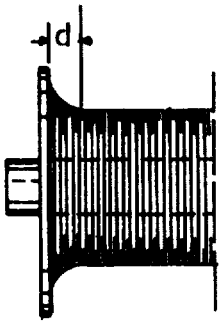
Figure 3B:
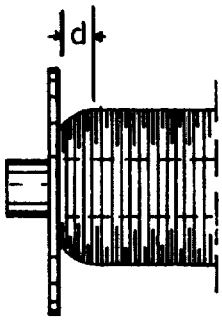
Figure 4B:
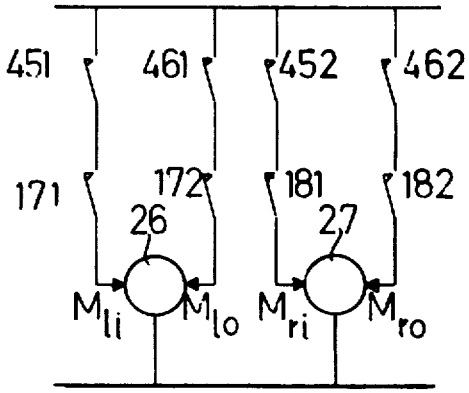
Figure 4A:
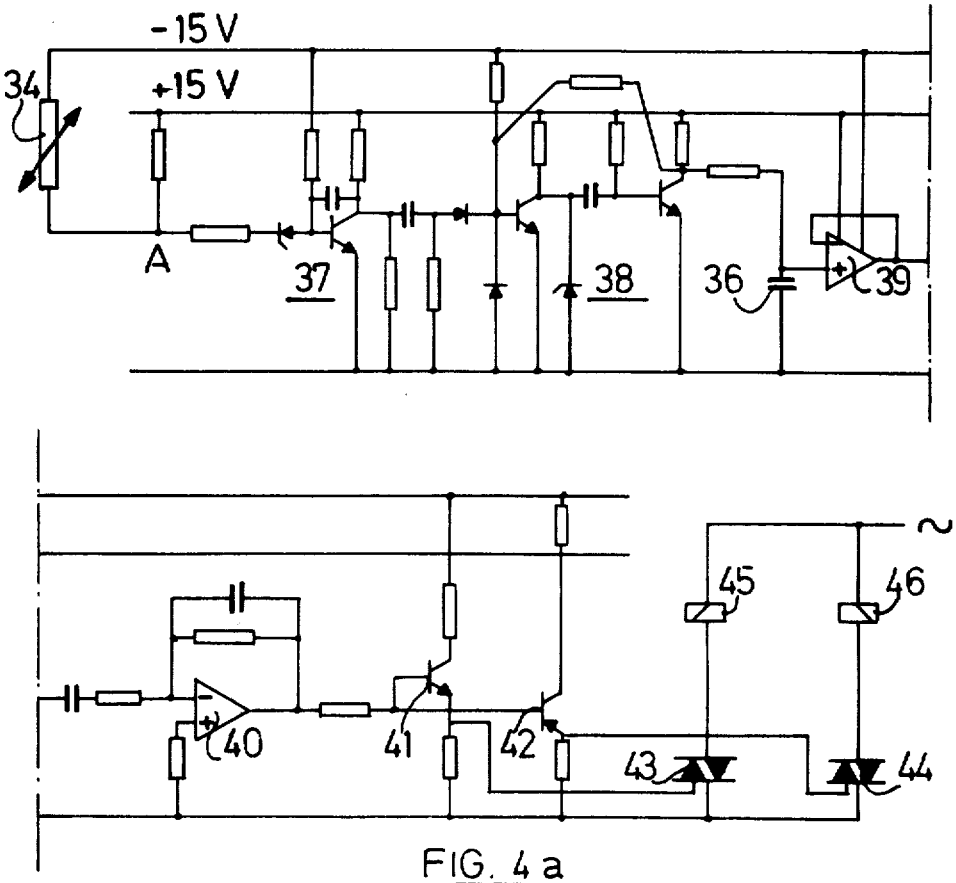

FIGS. 3*a* and 3*b* show respectively an accumulation and a deficiency of wire adjacent a flange of a spool; and FIGS. 4*a* and 4*b* show schematically a circuit diagram of the apparatus.

Figures 1, 2:
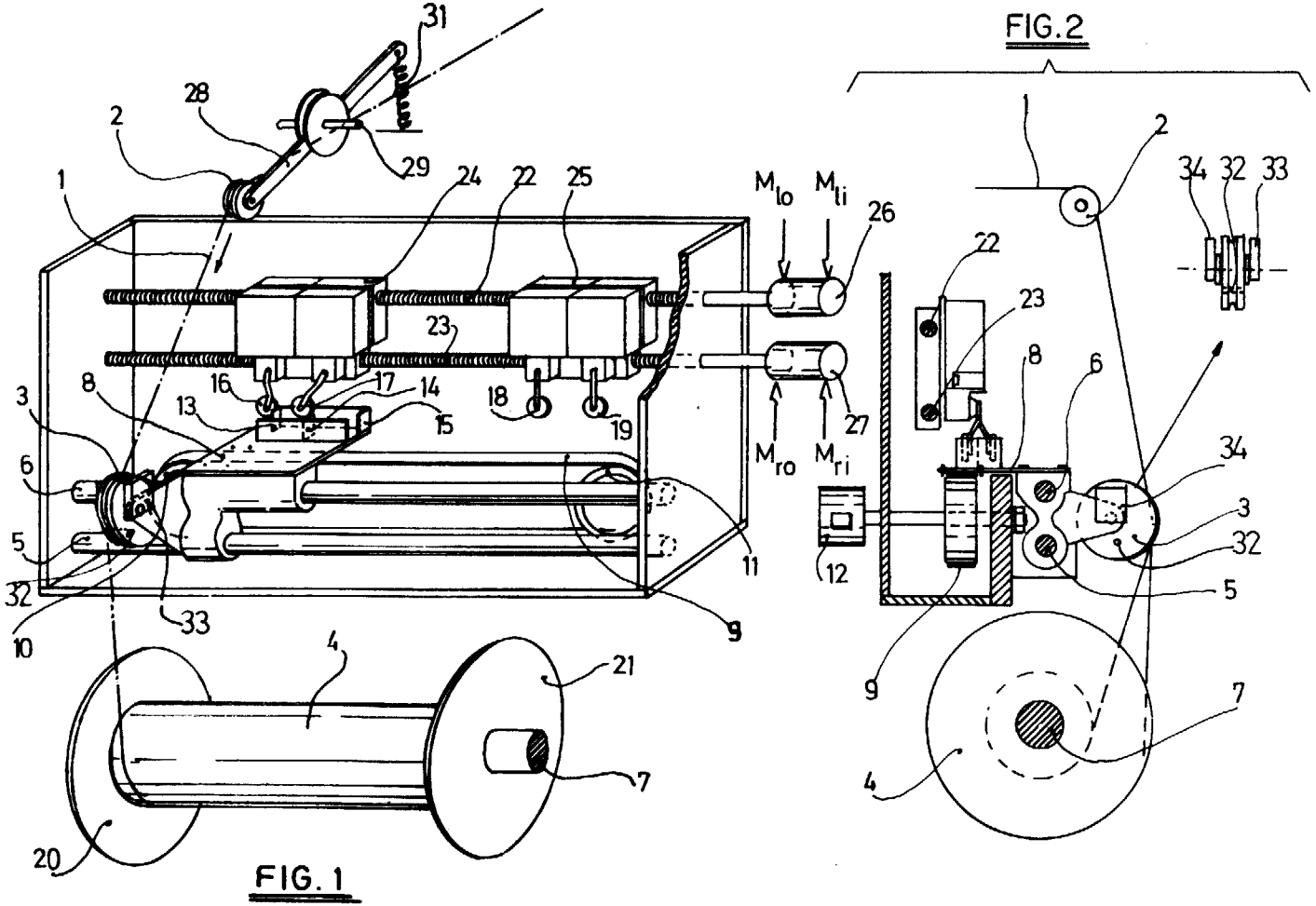
FIG. 1 is a schematic perspective view of the apparatus.
FIG. 2 is a lateral sectional view of the same apparatus of FIG. 1 and also shows separately an elevational view of the wire guide pulley.

Referring to FIGS. 1 and 2 of the drawings, a wire 1 is led from a wire drawing machine (not shown), over a dancer pulley 2 and a guide pulley 3 onto a spool 4 which has flanges 20 and 21 and which is fixed to a rotatable shaft 7. The pulley 3 forms part of a wire guide which includes a platform 8. The guide, in use, traverses back and forth along bars 5 and 6 between two end sensors in the form of end trips 16 and 19. The platform 8 is connected to a belt 9 which passes over pulleys 10 and 11. The pulley 10 is connected to a reversible motor 12 which is connected to the end trips 16 and 19 so that the direction of rotation of the reversible motor 12 is reversed at the end of each traverse.

Three cam plates 13, 14, and 15 are mounted on the platform 8. The cam plate 13 is positioned to actuate the end trip 16 at the end of each leftward traverse and the cam plate 15 is positioned to actuate the end trip 19 at the end of each rightward traverse.

The end trips 16 and 19 are suspended from carriers 24 and 25 respectively. Threaded rods 22 and 23 pass through both carriers 24 and 25 so that by rotating the rod 22 the carrier 24 can be moved and by rotating the rod 23 the carrier 25 can be moved. A reversible servo-motor 26 is coupled to the rod 22 for driving this rod so as to move the left-hand end trip 16 more outwardly or more inwardly in response to an input signal $M_{lo}$ or $M_{li}$ respectively. Likewise a reversible servo-motor 27 is coupled to the rod 23 for driving this rod so as to move the right-hand end-trip 19 more outwardly or more inwardly in response to an input signal $M_{ro}$ or $M_{ri}$ respectively.

In the same way, trips 17 and 18 are suspended from the carriers 24 and 25 respectively and so also move with the corresponding carrier in the direction of the traverse movement more outwardly or inwardly in accordance with the sense of rotation of the corresponding servo-motor. The cam plate 14 is positioned to actuate the trip 17 a distance *d* (see FIG. 3) before the end of each leftward traverse, and to actuate the trip 18 at the same distance *d* before the end of each rightward traverse. As the control system here described results in adjustment of the turning-points of the traverse movement to correspond with the positions of the flanges 20 and 21 of the spool 4, the actuation of trips 17 and 18 means that the guide pulley 3 is then guiding the wire over the zones of a breadth *d* adjacent to the flanges 20 and 21, respectively. The trips 17 and 18 thus perform the function of the abovementioned wire guide to flange proximity sensors.

When an end-trip is located too much outwardly, an accumulation of wire is formed in the zone near the flange as shown in FIG. 3*a*, and when the end-trip is too much inwardly, a deficiency is formed as shown in FIG. 3*b*. The control system here described is designed to react against such surface irregularity with a certain reaction speed which will only allow the accumulations or deficiencies to be built up to a maximum breadth *d*, which is the breadth of the zone where the surface irregularity must be sensed, and the same breadth as referred to above for the positioning of the trips 17 and 18.

As indicated above, the winding apparatus is provided with the dancer pulley 2 located upstream of the wire guide pulley 3, "upstream" being used with respect to the movement of the wire towards the spool 4 in the direction of the arrow in FIG. 1. This dancer pulley serves as a buffer-accumulator, and is mounted on an arm 28 which is rotatable about an axis 29 and is biased by a spring 31. When the speed of the wire delivering device upstream of the accumulator is higher than the speed at which the spool 4 draws the wire downstream, the arm 28 lifts under the influence of the spring 31; conversely the arm 28 dips under the influence of the drawing force of the wire downstream. The arm 28 additionally can be used for speed control of the delivering device to match it with the speed of the spool. Speed control can also be carried out on the rotation speed of the spool, provided that the speed changes are sufficiently smooth in order not to be interpreted as a surface irregularity by the detector described hereinafter. In general these changes will always be sufficiently smooth, having regard to the inertia of the spool and the wire thereon.

The guide pulley 3 is provided with an eccentric hole 32 which extends in the direction of the axis of the guide pulley 3 and, mounted non-rotatably, a light emitter 33 on one side of the pulley and a photoelectric cell receiver 34 on the other side. The hole 32 is so arranged as to allow transmission of the light from the emitter 33 to the receiver 34 once per revolution of the pulley, as well-known by those skilled in the art, in such a way that the receiver 34 receives light pulses at a rate which is proportional to the rotational speed of the guide pulley 3. It is sometimes desirable, for more accurate regulation, to provide the pulley with two or more holes, in order to have more pulses per revolution.

FIG. 4 shows the circuit diagram of the servo-mechanism system for correcting the position error of the end trips 16 and 19 on the carriers 24 and 25 respectively, in response to the detection of an accumulation or deficiency near the flanges of the spool 4. FIG. 4*a* shows an acceleration sensor for the rotational speed of the guide pulley 3, which rotational speed is proportional to the linear speed of the wire between the spool 4 and the dancer pulley 2 since the guide pulley is arranged to have a non-sliding contact with the wire. FIG. 4*b* shows a gate circuit which co-operates with the trips 17 and 18, as wire guide to flange proximity sensors, to allow the transmission of the acceleration sensor output signal to the servo-motors 26 and 27 only when the appropriate trip 17 or 18 has been put into an actuated condition by the cam plate 15.

The acceleration sensor of FIG. 4*a* comprises, as an input signal generator, the light pulse receiver 34 mentioned above; this receiver 34 is constituted by a photoresistor. The circuit basically comprises, connected one after the other, a threshold-circuit 37 for eliminating noise pulses, a pulse-shaper and calibrator 38, an integrating capacitor 36, an emitter-follower stage 39, a differentiator 40, and two transistor switches 41 and 42 for controlling the operation of a.c. semiconductor switches constituted by triacs 43 and 44 which are connected to control relays 45 and 46. The gate circuit of FIG. 4*b*, for controlling the input signals $M_{lo}$ and $M_{li}$ to the servo-motor 26 and $M_{ro}$ and $M_{ri}$ to the servo-motor 27, comprises electrical contacts 451 and 171 connected in series for providing the signal $M_{li}$, electrical contacts 461 and 172 connected in series for providing the signal $M_{lo}$, electrical contacts 452 and 181 connected in series for providing the signal $M_{ri}$, and electrical contacts 462 and 182 connected in series for providing the signal $M_{ro}$. The contacts 451 and 452 are the relay contacts of the relay 45 and are closed when the relay 45 is actuated by a current through the triac 43. Similarly, the contacts 461 and 462 are the relay contacts of the relay 46, and are closed when the relay 46 is actuated by a current through the triac 44. The contacts 171 and 172 are contacts which are closed when the trip 17 is in an actuated condition, and the contacts 181 and 182 are contacts which are closed when the trip 18 is in an actuated condition.

The circuit shown in FIG. 4*a* operates as follows: as photoresistor 34 receives light pulses at a rate proportional to the rotation speed of the guide-pulley 3, voltage pulses of a given amplitude are produced at this rate at the point A. The threshold-circuit 37 is arranged to have a threshold value less than the amplitude of such pulses but above noise level, so that only the signal pulses are transmitted to the pulse-shaper and calibrator 38, which is a monostable circuit which transforms each received pulse into a rectangular pulse of fixed amplitude and duration. The pulses appearing at the output of the monostable circuit are integrated by the integrating capacitor 36 so that the voltage across this capacitor fluctuates in proportion to the pulse rate, and consequently in proportion to the rotational speed of the guide pulley 3. This voltage is passed by the emitter-follower stage 39 to the differentiator 40, which delivers a positive or negative pulse in response to a sudden voltage rise or fall respectively. The switch 41 is sensitive to the positive pulses, and consequently also the triac 43 and the relay 45, in such a way that the relay 45 is actuated only when a sudden rise of the rotational speed of the guide-pulley 3 occurs. Analogously, the switch 42 is sensitive to the negative pulses, and consequently also the triac 44 and the relay 46, in such a way that the relay 46 is actuated only when a sudden fall of the rotational speed of the guide-pulley 3 occurs.

This means that a sudden rise in the linear speed of the wire results in the contacts 451 and 452 in FIG. 4*b* being closed, and a sudden fall results in the contacts 461 and 462 being closed. The relays 45 and 46 can be, if necessary, timing relays which, on receipt of a pulse, become closed for a fixed time.

In operation, and supposing that the carrier 24 and the end-trip 16 are positioned too much to the left, so that an accumulation (FIG. 3*a*) is formed, when the wireguide during its leftward stroke arrives in the proximity of its left-hand turning point the trip 17 is actuated and the contacts 171 and 172 close. Then, before the wire guide reaches the turning point, the guide pulley 3 leads the wire 1 over the accumulation near the flange 20, and a sudden increase in the speed of the wire occurs. This is detected as described above and results in the contacts 451 and 452 closing. The other contacts of FIG. 4*b* are at rest and open. In this situation the contacts 451 and 171 are the only series-connected contacts which are closed together, so that the input signal $M_{li}$ is produced to actuate the servo-motor 26 for a short time to give a small inward step to the carrier 24. The converse occurs if the carrier 24 is positioned too much inwardly, that is to say to the right. Then a deficiency (FIG. 3*b*) would appear, which results in a sudden fall in the speed of the wire, which is detected and results in the contacts 461 and 462 closing instead of the contacts 451 and 452. As this happens with trip 17 being actuated, contacts 171 and 172 are closed so that the series-connected contacts 461 and 172 are closed together to produce the input signal $M_{lo}$ to actuate the servo-motor 26 for a short time to give a small outward step to the carrier 24. In an analogous way, the same occurs with carrier 25 when it deviates from its correct position, where the servo-motor 27 is actuated by its input signals $M_{ri}$ and $M_{ro}$ for driving the carrier 25 inwardly or outwardly respectively, in response to an accumulation or deficiency respectively, adjacent to the flange 21.

The apparatus shown in the drawings and the control-system as explained herein are only given by way of example and it will be understood that many other ways of reailizing the invention can be designed by those skilled in the art, without departing from the scope of the invention as defined in the appended claims.

What is claimed is:

1. A method of detecting, during the winding of a thread onto a flanged spool by a winding apparatus having a thread guide which traverses the thread back and forth lengthwise of the spool, irregularities of the surface of the wound thread in two zones each adjacent to a respective one of the flanges of the spool, the method comprising sensing changes of the linear speed of the thread being supplied to the spool when the thread guide guides the thread into one of said zones, said changes being sensed between the spool and an upstream located buffer-accumulator.

2. The method of claim 1 wherein the thread is a wire.

3. The method of claim 1 wherein changes of the linear speed of the thread are sensed by passing the thread over a freely rotatable guiding wheel upstream of the spool and sensing changes of the rotational speed of the guiding wheel.

4. The method of claim 3 wherein the thread is a wire.

5. A method of compensating, during the winding of a thread onto a flanged spool by a winding apparatus having a thread guide which traverses the thread back and forth lengthwise of the spool between two adjustable positionable turning points, for irregularities of the surface of the wound thread in two zones each adjacent to a respective one of the flanges of the spool, the method comprising detecting such irregularities by the method of claim 1 and adjusting the position of the respective one of the turning points in response to a sensed change of the linear speed of the thread being guided into the respective one of said zones.

6. The method of claim 5 wherein the thread is a wire.

7. Winding apparatus for winding wire, thread or the like onto a flanged spool comprising:

thread guide means for traversing the wire or thread back and forth lengthwise of the spool during winding;

means for detecting surface irregularities of the wound wire or thread in two zones each adjacent to a respective one of the spool flanges, said means for detecting comprising: a buffer-accumulator located upstream of the spool, means for sensing changes of the linear speed of the thread upstream of the spool, said sensing means being located between the spool and said buffer-accumulator, and gating means for inhibiting the output from said sensing means except when said thread guide means is in a position to guide the thread or wire into one of said zones.

8. Winding apparatus as claimed in claim 7 wherein said thread guide means includes means to traverse the thread back and forth between two adjustably positionable turning points, said apparatus including two control systems each of which comprises means for adjusting the position of a respective one of the turning points, with respect to the position of the corresponding spool flange, in response to a respective output signal from said detecting means in such a direction as to compensate for the detected surface irregularity of the wound thread in the respective one of said two zones.

9. Winding apparatus as claimed in claim 7 wherein said sensing means comprises a freely rotatable guiding wheel arranged for non-sliding contact with the thread being supplied to the spool and means for sensing changes of the rotational speed of said guiding wheel.

10. Winding apparatus as claimed in claim 9 wherein said guiding wheel is a part of said thread guide means.

11. Winding apparatus as claimed in claim 9 wherein said means for sensing a change of the rotational speed of said guiding wheel comprises pulse-generator means for producing a predetermined number of pulses per revolution of said guiding wheel, pulse-to-DC transformer means connected to the output of said pulse generator means for delivering a DC-level representative of the pulse rate, and a differentiator connected to the output of said pulse-to-DC transformer means.

12. Winding apparatus as claimed in claim 8 wherein said sensing means comprises a freely rotatable guiding wheel arranged for non-sliding contact with the thread being supplied to the spool and means for sensing changes of the rotational speed of said guiding wheel.

13. Winding apparatus as claimed in claim 12 wherein said guiding wheel is a part of said thread guide means.

14. Winding apparatus as claimed in claim 12 wherein said means for sensing a change of the rotational speed of said guiding wheel comprises pulse-generator means for producing a predetermined number of pulses per revolution of said guiding wheel, pulse-to-DC transformer means connected to the output of said pulse generator means for delivering a DC-level representative of the pulse rate, and a differentiator connected to the output of said pulse-to-DC transformer means.

15. A method of compensating, during the winding of a thread onto a flanged spool by a winding apparatus having a thread guide which traverses the thread back and forth lengthwise of the spool between two adjustable positionable turning points, for irregularities of the surface of the wound thread in two zones each adjacent to a respective one of the flanges of the spool, the method comprising detecting such irregularities by the method of claim 7 and adjusting the position of the respective one of the turning points in response to a sensed change of the linear speed of the thread being guided into the respective one of said zones.

* * * * *